US009244400B2

(12) United States Patent
Nagata

(10) Patent No.: US 9,244,400 B2
(45) Date of Patent: Jan. 26, 2016

(54) IMAGE HEATING APPARATUS

(71) Applicant: CANON KABUSHIKI KAISHA, Tokyo (JP)

(72) Inventor: Teppei Nagata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/709,930

(22) Filed: May 12, 2015

(65) Prior Publication Data

US 2015/0331370 A1 Nov. 19, 2015

(30) Foreign Application Priority Data

May 16, 2014 (JP) ..... 2014-102159

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 7,224,922 | B2 | 5/2007 | Kemmochi | |
| 8,831,492 | B2 | 9/2014 | Nagata | |
| 8,913,936 | B2 | 12/2014 | Takada et al. | |
| 8,923,738 | B2 | 12/2014 | Nagata | |
| 2005/0185978 | A1 | 8/2005 | Kemmochi | |
| 2012/0213539 | A1* | 8/2012 | Maruko | G03G 15/2025 399/67 |
| 2013/0308966 | A1 | 11/2013 | Masuda et al. | |
| 2015/0104205 | A1* | 4/2015 | Moteki | G03G 15/2053 399/43 |
| 2015/0212465 | A1* | 7/2015 | Momma | G03G 15/2017 399/67 |

FOREIGN PATENT DOCUMENTS

| | | |
|---|---|---|
| JP | 2005-266785 | 9/2005 |
| JP | 2007-256369 | 10/2007 |
| JP | 2013-242398 | 5/2015 |

* cited by examiner

*Primary Examiner* — G. M. Hyder
(74) *Attorney, Agent, or Firm* — Fitzpatrick, Cella, Harper & Scinto

(57) ABSTRACT

An image heating apparatus includes: first and second rotatable members configured to heat an image on a sheet at a nip; a roughening member configured to perform roughening of a surface of the first rotatable member when at least the first rotatable member of the first and second rotatable members rotates; a moving mechanism configured to move the roughening member relative to the first rotatable member so that the roughening member is movable between a contact position where the roughening member is contacted to the first rotatable member and a spaced position where the roughening member is spaced from the first rotatable member; an obtaining portion configured to obtain information indicating that the first rotatable member is new; and a controller configured to control the moving mechanism to perform the roughening upon obtaining of the information by the obtaining portion.

10 Claims, 14 Drawing Sheets

IMAGE HEATING APPARATUS

The present invention relates to an image heating apparatus for heating an image on a sheet. The image heating apparatus is used in an image forming apparatus such as a copying machine, a printer, a facsimile machine or a multi-function machine having a plurality of functions of these machines.

In a conventional image forming apparatus, a fixing device fixes the image on the sheet by heating and pressing a toner image formed on the sheet. One type of fixing device is a, fixing device of a type using a fixing roller as a rotatable heating member (Japanese Laid-Open Patent Application 2005-266785).

Japanese Laid-Open Patent Application 2005-266785 discloses a constitution for repairing a surface of the fixing device in the case where the surface of the fixing roller is roughened with use of the fixing device. Specifically, the fixing device includes a surface-shape improving member having a desired surface state required for a fixing roller surface, a supporting member for supporting the surface shape improving member, a solenoid, and a solenoid driving circuit for driving the solenoid. In the case where the fixing roller surface is roughened with the use of the fixing device, the fixing device controls the solenoid driving circuit to bring the surface-shape improving member into contact with the fixing roller surface, so that the fixing roller surface is repaired.

That is, in the fixing device disclosed in Japanese Laid-Open Patent Application 2005-266785, in the case where the roughness of the fixing roller surface is not a desired roughness, the fixing roller surface is repaired to have the desired roughness. For that reason, the fixing device can fix the image on the sheet at a desired image quality by the fixing roller having a desired surface roughness.

However, in some cases, the roughness of the fixing roller surface is not the desired roughness independently of roughening with the use of the fixing device. For example, even when the fixing device is in a brand-new condition, there is a liability that the roughness of the fixing roller surface is not the desired roughness.

Specifically, there is a case where a foreign matter contacts the fixing roller surface during transportation of the fixing device. In the case where the image forming apparatus is initially disposed or in the case where the fixing device is exchanged, the device (apparatus) assembled in a factory is transported. During the transportation, in the case where an unexpected force is applied to the device, there is a liability that a member not normally in with the fixing roller during transportation, e.g., a separating plate for assisting with separation of the sheet from the fixing roller, contacts the fixing roller surface. When the fixing roller surface is damaged by the contact with the separating plate, the roughness thereof is not the desired roughness.

In this way, in the case where the fixing of the image on the sheet is performed using the fixing device in which the roughness of the fixing roller surface is not the desired roughness, there is a liability that the image does not have a desired quality and an image defect is generated.

SUMMARY OF THE INVENTION

A principal object of the present invention is to provide an image heating apparatus capable of supporting generation of an image defect.

According to an aspect of the present invention, there is provided an image heating apparatus comprising: first and second rotatable members configured to heat an image on a sheet at a nip; a roughening member configured to perform roughening of a surface of the first rotatable member when at least the first rotatable member of the first and second rotatable members rotates; a moving mechanism configured to move the roughening member relative to the first rotatable member so that said roughening member is movable between a contact position where the roughening member is contacted to the first rotatable member and a spaced position where the roughening member is spaced from the first rotatable member; obtaining means configured to obtain information indicating that the first rotatable member is a new one; and control means configured to control the moving mechanism to perform the roughening upon obtaining of the information by the obtaining portion.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7A-7C are schematic views for illustrating a roughening nip forming mechanism, wherein FIG. 7A is a partially perspective view, FIG. 7B is a partially sectional view, and FIG. 7C is a partially perspective view.

DESCRIPTION OF THE EMBODIMENTS

Embodiment 1

(1) Image Forming Portion

Figure 2:
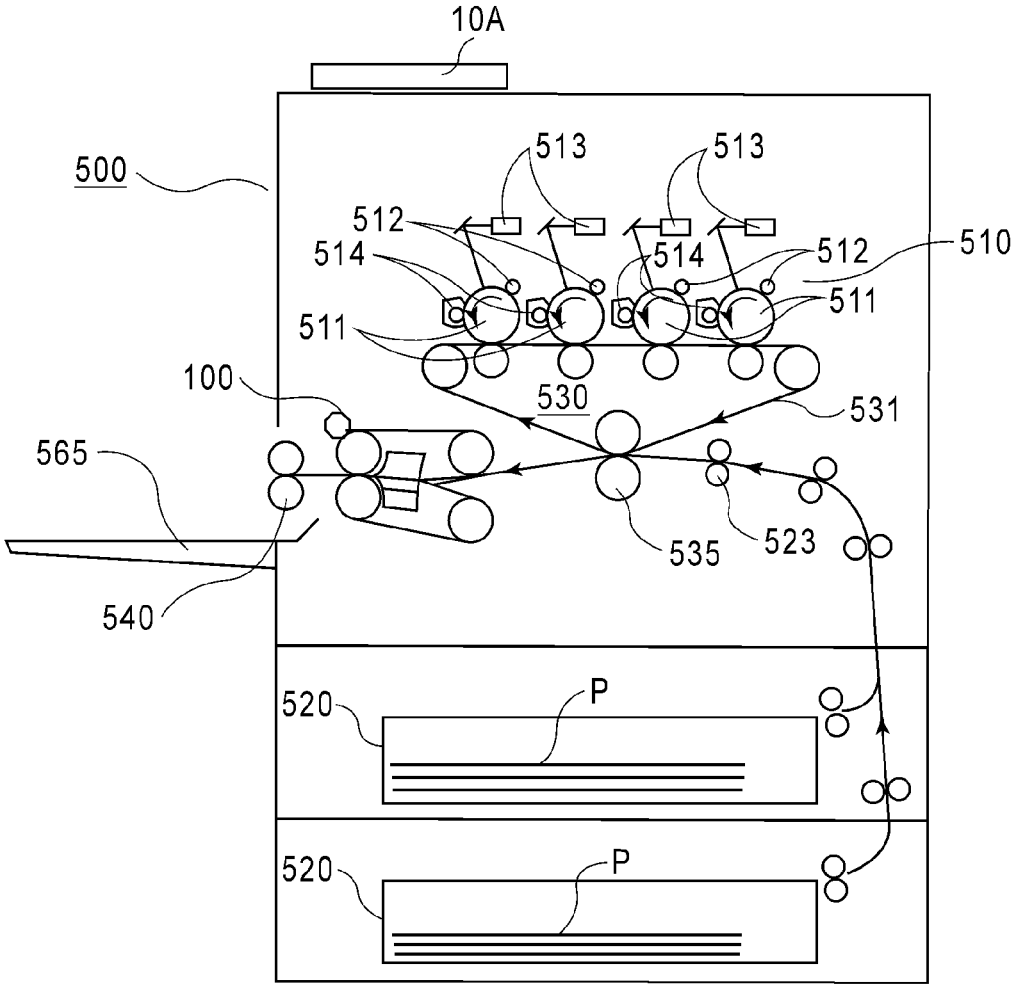
FIG. 2 is an illustration showing a cross-section of an image forming apparatus in the embodiment.

FIG. 2 is a schematic structural view of a color electrophotographic printer 500, which is an example of an image forming apparatus, and is a sectional view of the printer 500 in this embodiment along a feeding direction of a sheet (recording material) P as a recording medium.

An image forming portion 510 of this printer 500 includes four photosensitive drums 511, which are arranged in a tandem manner, for forming toner images (images) of colors of Y (yellow), M (magenta), C (cyan) and Bk (black), respectively.

A toner image forming operation performed by the image forming portion 510 is performed in the following manner. First, each of the photosensitive drums 511 is electrically charged by a charging roller 512. Thereafter, each photosensitive drum 511 is exposed to light by a laser scanner 513, so that a latent image is formed. The respective latent images are developed by developing devices 514 into toner images of the respective colors. The toner images on the respective photosensitive drums 511 are successively superposed on an intermediary transfer belt 531 of an intermediary transfer unit 530, thus being primary-transferred. As a result, unfixed four color toner images are synthetically formed on the intermediary transfer belt 531. As each of the toners, a toner enhanced in melting property by incorporating a parting agent (paraffin wax or the like) in the toner is used.

On the other hand, the sheet P is fed in the following manner. The sheets P are fed one by one from a first or second feeding cassette 520 and are sent to a registration roller pair 523. The registration roller pair 523 once stops the sheet P passing therethrough, and rectifies the orientation of the sheet P so as to correct the inclination of the sheet P in the case where the sheet P is inclined and moved. Then, the registration roller pair 523 feeds the sheet P between the intermediary transfer belt 531 and a secondary transfer roller 535 in synchronism with the toner images on the intermediary transfer roller 531.

Thus, when the toner images are fed between the intermediary transfer belt 531 and the secondary transfer roller 535, and the color toner image on the intermediary transfer belt 531 is transferred on the sheet P by the secondary transfer roller 535. Thereafter, the toner image on the sheet P is fixed on the sheet P by being heated and pressed in a fixing device 100. Then, the sheet P on which the toner image is fixed is fed and discharged as a color image-formed product by a discharging roller pair 540 onto a discharge tray 565 provided at a side portion of the printer.

(2) Fixing Device (2-1) Basic Structure

Figure 1:
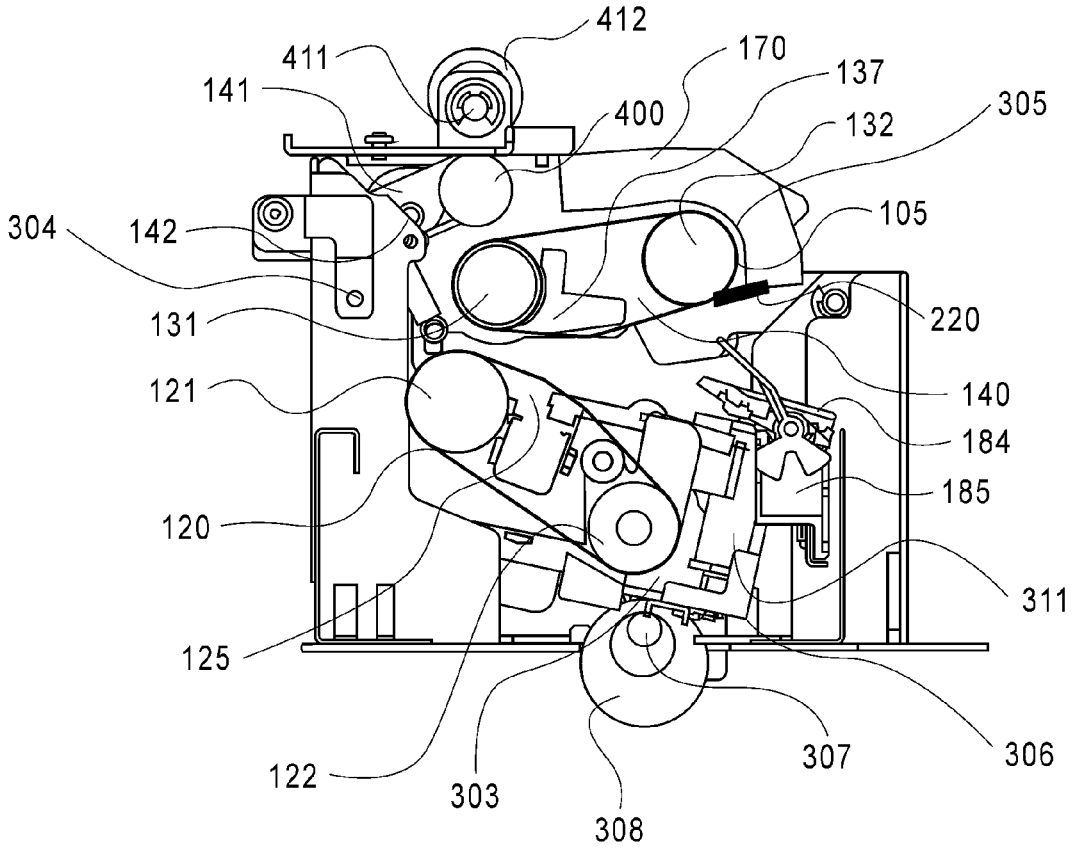
FIG. 1 is an illustration showing a cross-section of a fixing device in an embodiment.
Figure 3:
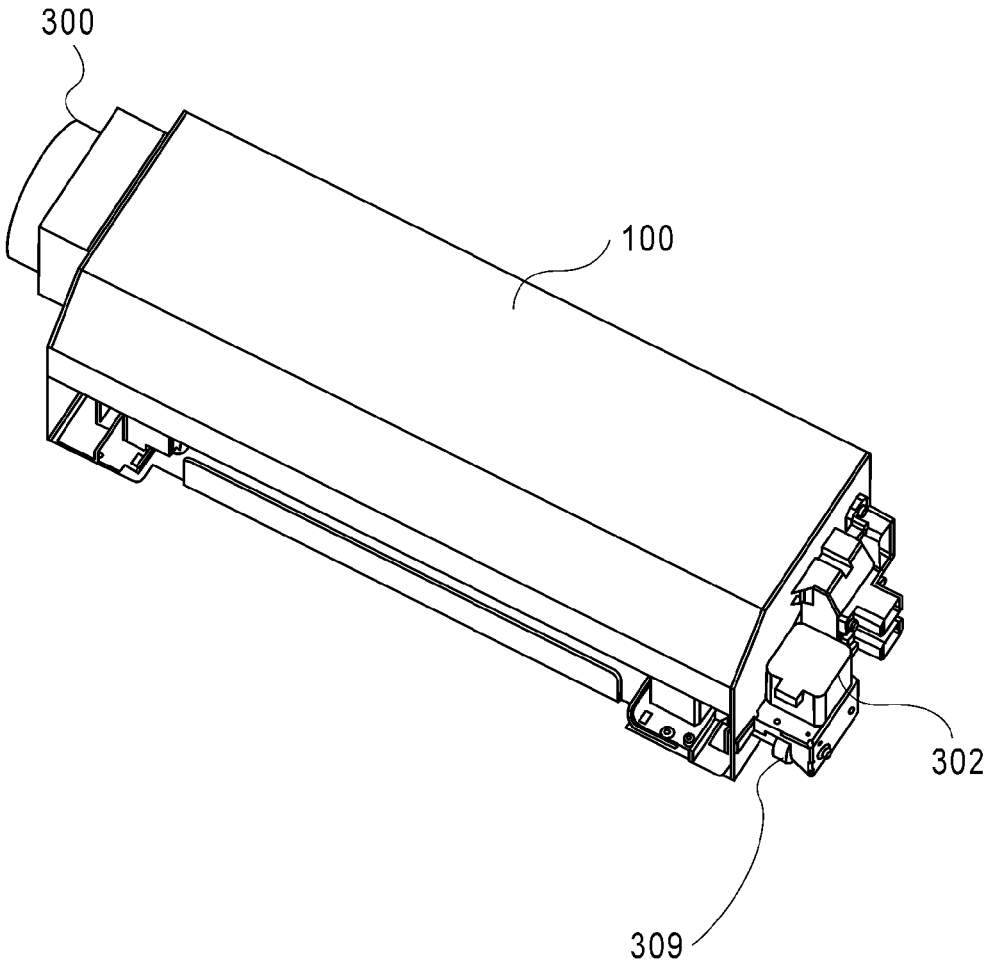
FIG. 3 is a perspective view showing an outer appearance of the fixing device in the embodiment.
Figure 4:
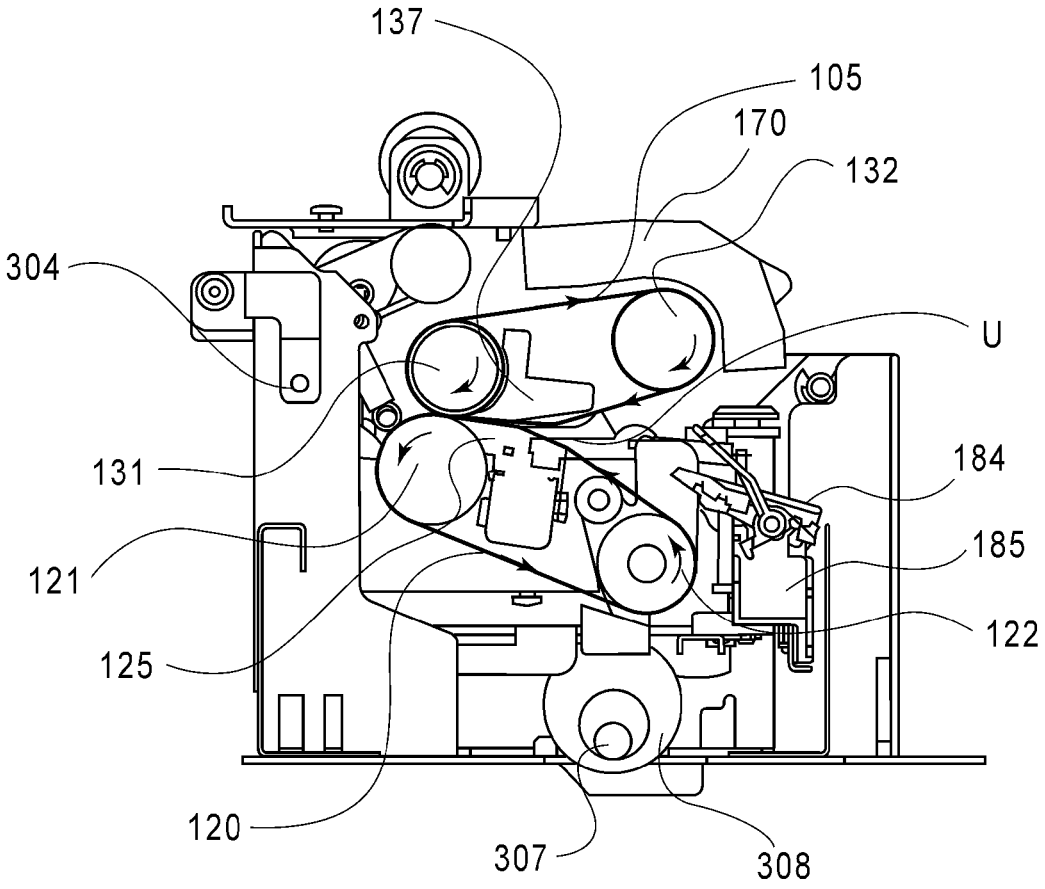
FIG. 4 is an illustration showing a side surface of the fixing device in the embodiment.
Figure 5:
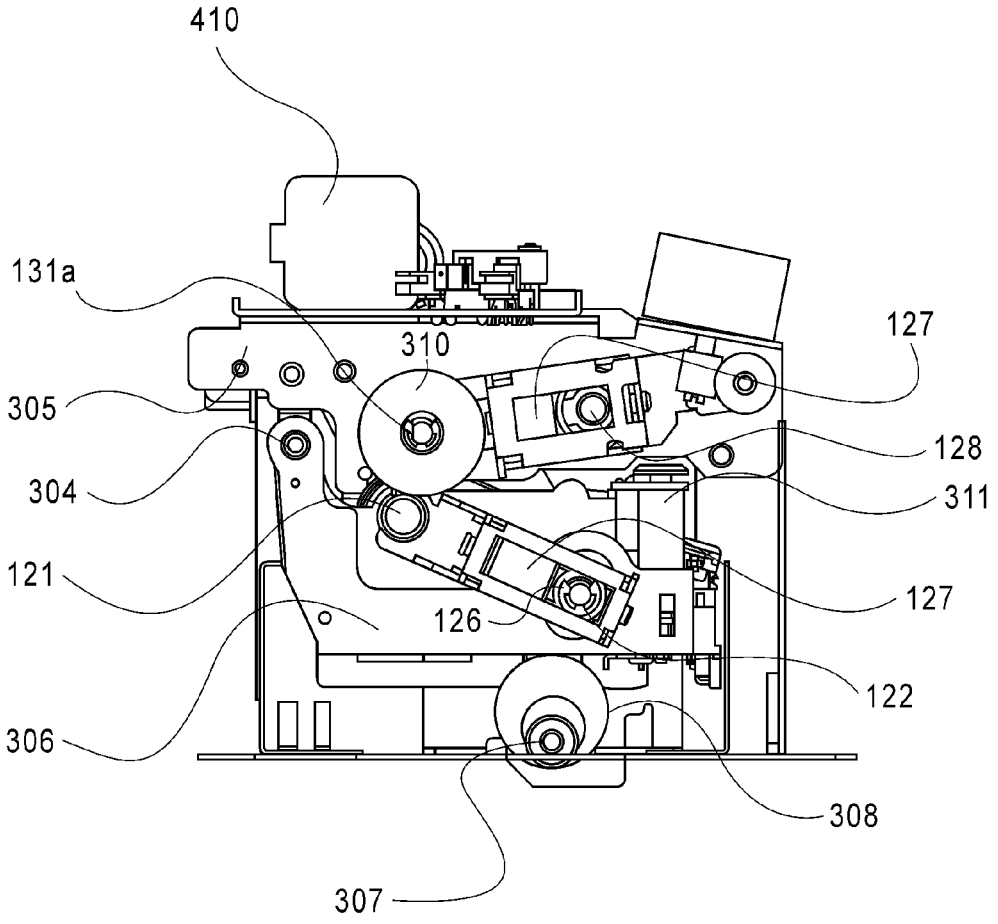
FIG. 5 is an illustration showing a side surface of the fixing device in the embodiment.

In this embodiment, the fixing device 100 is a device of an electromagnetic induction heating belt type and an oil-less fixing type. FIGS. 1 and 4 are cross-sectional views of the fixing device 100, and FIG. 3 is a perspective view of the fixing device 100. FIG. 5 is an illustration of a belt tension mechanism in the fixing device 100.

A fixing belt 105 is a rotatable heating member for heating the image in contact with an image carrying surface of the sheet (recording material) P in a nip U described later. An IH heater (magnetic flux generating means) 170 is a heating source provided in the neighborhood of the surface of the fixing belt 105 in order to heat the fixing belt 105, and is disposed above the fixing belt 105 in this embodiment.

The IH heater 170 includes a holder for holding an exciting coil and a magnetic core. The exciting coil generates AC magnetic flux by an AC current, and the AC magnetic flux generates an eddy current in the fixing belt 105, which is an induction heat generation member by being introduced into the magnetic core. The eddy current generates Joule heat by the specific resistance of the induction heat generating member. The fixing device 100 in this embodiment supplies the AC current to the coil so that the surface temperature of the fixing belt 105 is about 150° C. In the fixing device 100 in this embodiment, the surface temperature of the fixing belt 105 is obtained on the basis of output information of a thermistor 220 for detecting the surface temperature of the fixing belt 105.

A pressing belt 120 is a nip forming member for forming a fixing nip (nip portion) U, for nipping and feeding the sheet P, in cooperation with the fixing belt 105. The pressing belt 120 is extended and stretched around a pressing roller 121 and a tension roller 122, which are two supporting rollers, so as to be capable of being circulated and rotated. The tension roller 122 has the function of imparting tension to the pressing belt 120, so that a predetermined tension (e.g., 200N) is applied to the pressing belt 120.

A member used for the pressing belt 120 may appropriately be selected if the member has a heat-resistant property. As the pressing belt 120, e.g., a belt member is used that is prepared by coating a 300 μm-thick silicone rubber on a nickel metal layer of 50 μm in thickness, 380 mm in width and 200 mm in circumferential length and then by coating a PFA (perfluoroalkoxyalkane) tube as a surface layer.

The fixing belt 105 is an endless belt member extended and stretched around a driving roller 131 and a tension roller 132, which are two supporting rollers, so as to be capable of being circulated and rotated. The tension roller 132 has the function of imparting tension to the fixing belt 105, so that a predetermined tension (e.g., 200N) is applied to the fixing belt 105.

As the fixing belt 105, a member may appropriately be selected if the member is caused to generate heat by the IH heater 170 and has the heat-resistance property. As the fixing belt 105, a member is used that is prepared by coating a 300 μm-thick silicone rubber (elastic layer) on a magnetic metal layer (substrate) such as a nickel layer or a stainless steel layer of 75 μm in thickness, 380 mm in width and 200 mm in circumferential length and then by coating the PFA tuber as a surface layer.

Inside the pressing belt 120, a pressing pad 125 for forming an upstream portion (entrance portion) of the fixing nip U with respect to a sheet feeding direction is provided. The pressing pad 125 contacts an inner surface of the pressing belt 120. As the pressing pad 125, an elastic member such as a silicone rubber is used.

Further, inside the pressing belt 120, the pressing roller 121 for forming a downstream portion (exit portion) of the fixing nip U with respect to the sheet feeding direction is provided. As the pressing roller 121, e.g., a solid roller formed of stainless steel and 20 mm in outer diameter can be used.

End portions of the tension roller 122 are supported by bearings 126, and the tension of 20 kgf is applied to the pressing belt 120 by tension springs 127. The tension roller 122 is a hollow roller and is formed of, e.g., stainless steel, to have an outer diameter of about 20 mm and an inner diameter of about 18 mm.

Inside the fixing belt 105, a pad stay 137 for forming an upstream portion (entrance portion) of the fixing nip U with respect to the sheet feeding direction is provided. The pad stay 137 contacts the fixing belt 105. The pad stay 137 is a member formed of, e.g., stainless steel (SUS material).

The driving roller 131 is roller formed by integral molding of a solid metal core formed of stainless steel and having an outer diameter of 18 mm with a heat-resistant silicone rubber elastic layer. The driving roller 131 is disposed so as to from an exit portion (downstream portion) of the fixing nip U. The driving roller 131 can elastically deform the elastic layer by a predetermined amount in the case where the driving roller 131 is press-contacted to the fixing belt 105 toward the pressing roller 121 via the pressing belt 120.

The tension roller 132 is a hollow roller formed of, e.g., stainless steel, to have an outer diameter of about 20 mm and an inner diameter of about 18 mm. The tension roller 132 is supported at end portions by bearings 128 and is pressed against the fixing belt 105 by tension springs 127, so that the tension of 20 kgf is applied to the fixing belt 105. The tension roller 132 in this embodiment has the function of adjusting meandering of the fixing belt 105 with respect to a widthwise direction perpendicular to a movement direction of the fixing belt 105.

A driving motor 300 (FIG. 3) is a driving means for rotating the fixing belt 105 by inputting a drive force (driving force) into a drive inputting gear 310 fixed on a shaft 131*a* (FIG. 5) of the driving roller 131. In this embodiment, the driving motor 300 is disposed outside the fixing device 100.

The fixing device 100 in this embodiment controls the rotational speed of the driving motor 300, thus controlling the feeding speed of the fixing belt 105 at two levels. One is a feeding speed Va during fixing in which the sheet P is nipped and fed through the fixing nip U and the image is fixed on the sheet P. The other is a feeding speed Vb used during rising of the image forming apparatus 500. During the rising, the temperature of the fixing belt 105 is heated up to a target temperature (150° C.) or maintained at the target temperature before the timing of the fixing operation. In this case, the fixing belt 105 is heated by the IH heater 170 while being rotated, so that a full circumference of the fixing belt 105 can be uniformly heated.

In order to improve productivity of the fixing operation, it is desirable that the feeding speed Va is made higher. On the other hand, the feeding speed Vb for maintaining the temperature of the full circumference of the fixing belt 105 to be uniform is not required to be a speed corresponding to the feeding speed Va. In this embodiment, the rotational speed of the driving motor is 3000 rpm at the feeding speed Va and is 300 rpm at the feeding speed Vb.

An upper frame 305 is a member for rotatably supporting the driving roller 131 and includes an upper plate 140 for holding an end portion of the pad stay 137. A lower frame 306 is a member for rotatably supporting the pressing roller 121 and includes a lower plate 303 for holding an end portion of the pressing pad 125. Alternatively, the lower frame 306 is rotatably supported by a hinge shaft 304 provided on the lower plate 303.

The lower frame 306 is constituted so as to movable between a pressing position shown in FIG. 4 and a spaced position shown in FIG. 1 by rotation of a pressing cam 308 provided at each of end portions of a pressing cam shaft 307. The pressing cam shaft 307 is rotated by driving a pressing motor 302 (FIG. 3) to operate a pressing gear 309.

At the pressing position shown in FIG. 4, the fixing belt 105 and the pressing belt 120 contact each other to form the fixing nip U. Specifically, the fixing belt 105 and the pressing belt 120 are sandwiched in an upstream side of the fixing nip U between the pad stay 137 and the pressing pad 125. The fixing belt 105 and the pressing belt 120 are sandwiched in a downstream side between the driving roller 131 and the pressing roller 121. To the fixing nip U, a predetermined pressure (e.g., 400N) is applied by the pressing springs 311.

Figure 6:
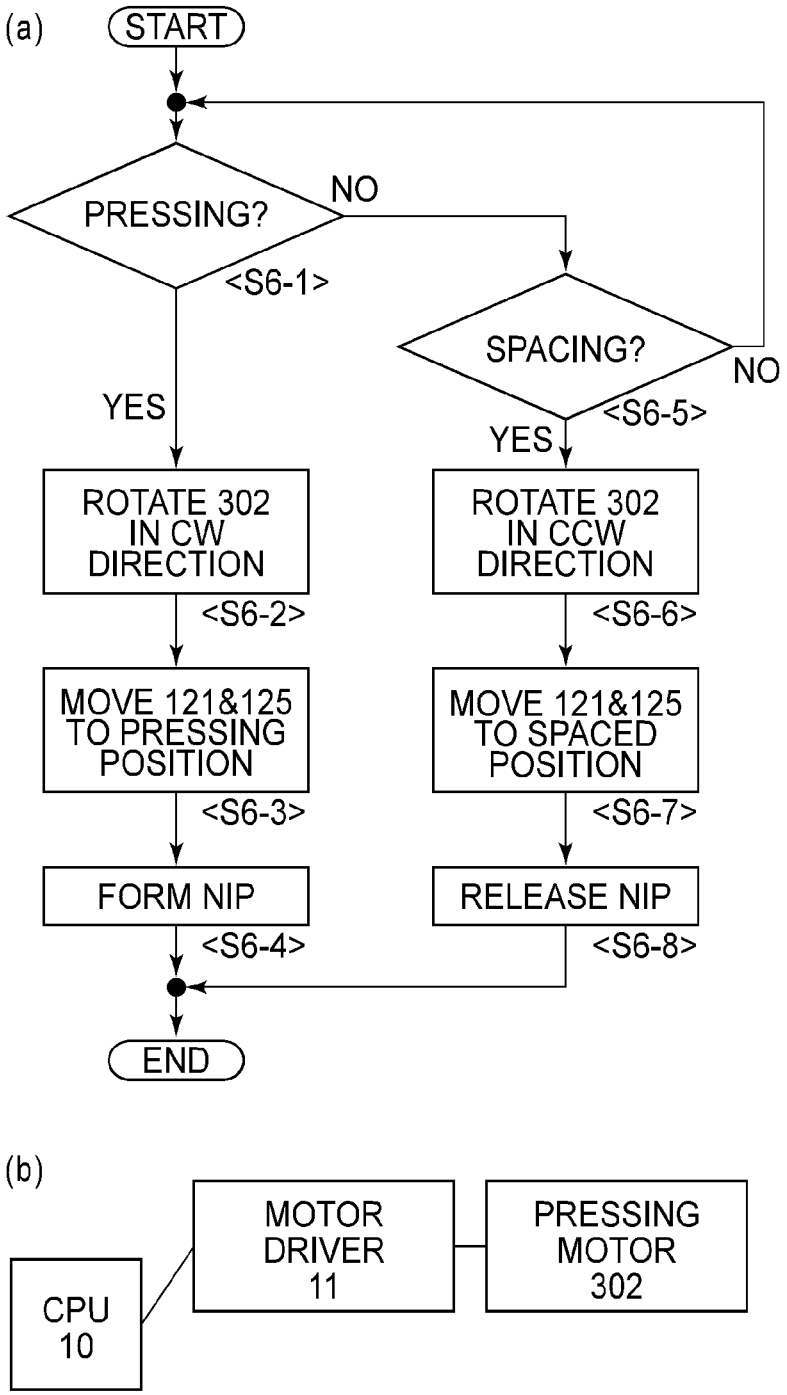
In FIG. 6, (a) is a flowchart for illustrating a fixing nip forming operation in the embodiment, and (b) is a block diagram of a constitution relating to the fixing nip forming operation in the embodiment.

A forming operation of the fixing nip U by movement of the pressing roller 121 and the pressing pad 125 will be described using a flowchart and a block diagram shown in (a) and (b) of FIG. 6, respectively.

The fixing device 100 effects control relating to the forming operation of the fixing nip U by a printer controller (control means: CPU) 10.

In the case where the fixing nip U is formed, the CPU 10 provides a pressing instruction to a motor driver 11 <S6-1>. After receiving the pressing instruction from the CPU 10, the motor driver 11 rotates the pressing motor 302 (FIG. 3) in the clockwise (CW) direction by a predetermined number (N) of rotations <S6-2>. When driving of the pressing motor 302 is transmitted to the pressing cam shaft 307 by the pressing gear 309, the lower frame 306 is pushed up by the pressing cam shaft 307. Then, the pressing pad 125 and the pressing roller 121, which are supported by the lower frame 306, are moved to a pressing position <S6-3>. By the movement of the pressing pad 125 and the pressing roller 121 to the pressing position, the fixing belt 105 and the pressing belt 120 are press-contacted to each other, so that the fixing nip U is formed <S6-4>.

In the case where the formation of the fixing nip U is eliminated, the CPU 10 provides a spacing instruction to the motor driver 11<S6-5>. After receiving the spacing instruction from the CPU 10, the motor driver 11 rotates the pressing motor 302 (FIG. 3) in the counterclockwise (CCW) direction by a predetermined number (N) of rotations <S6-6>. When driving of the pressing motor 302 is transmitted to the pressing cam shaft 307 by the pressing gear 309, the lower frame 306 is supported at a lower position by the pressing cam shaft 307. Then, the pressing pad 125 and the pressing roller 121, which are supported by the lower frame 306, are moved to a spaced position <S6-7>. As a result, the fixing nip U is eliminated <S6-8>.

During formation of the image at the image forming portion 510 of the printer 500, the fixing device 100 is in a stand-by state in a state in which the fixing nip U is formed by causing the fixing belt 105 and the pressing belt 120 to press-contact each other. In the stand-by state, the fixing device 100 rotationally drives the fixing belt 105 and the pressing belt 120 in arrow directions by the drive of the driving roller 131. Further, the fixing device 100 controls the temperature of the fixing belt 105 by using the IH heater 170 so as to be a predetermined temperature (fixing temperature).

When the sheet P on which the unfixed toner image is carried is fed from the secondary transfer roller 535 side, the fixing device 100 nips and feeds the sheet P in the fixing nip U.

The sheet P carrying the toner image is, in a process in which the sheet P is nipped and fed through the fixing nip U, heated by heat of the fixing belt 105 and pressed by a pressing force between the fixing belt 105 and the pressing belt 120. Thus, the image is fixed on the sheet. That is, the fixing belt 105 and the pressing belt 120 constitute a pair of rotatable members for heating the image on the sheet P at the nip. At this time, the fixing belt 105 functions as one of the rotatable members. Then, the sheet P coming out of the fixing device 100 is fed and discharged onto the discharge tray 565 by the discharging roller pair 540 as described above.

(2-2) Roughening Mechanism

Figure 7A:
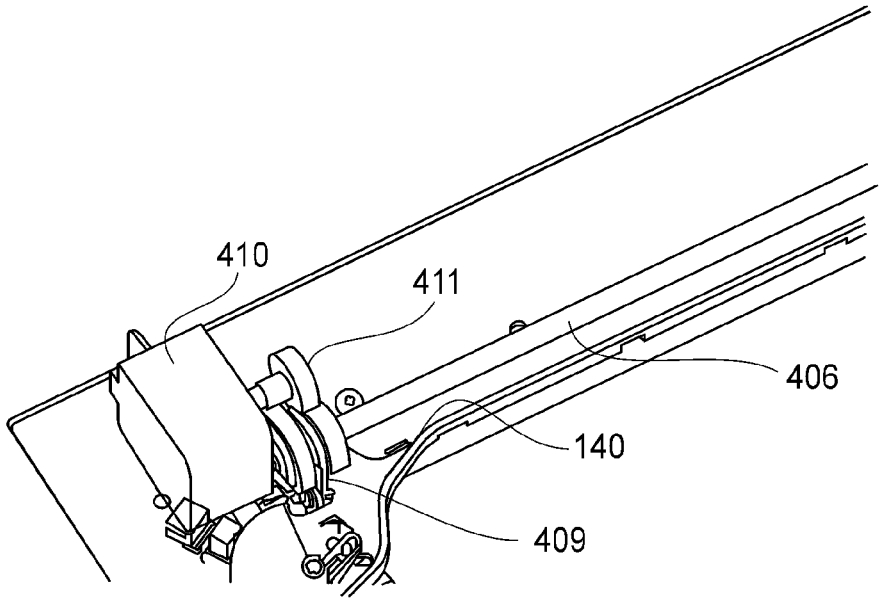
Figure 7B:
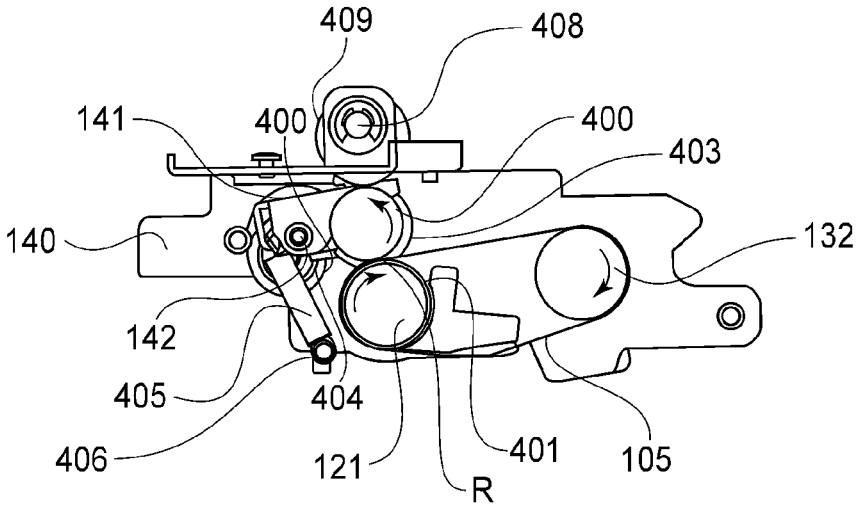
Figure 7C:
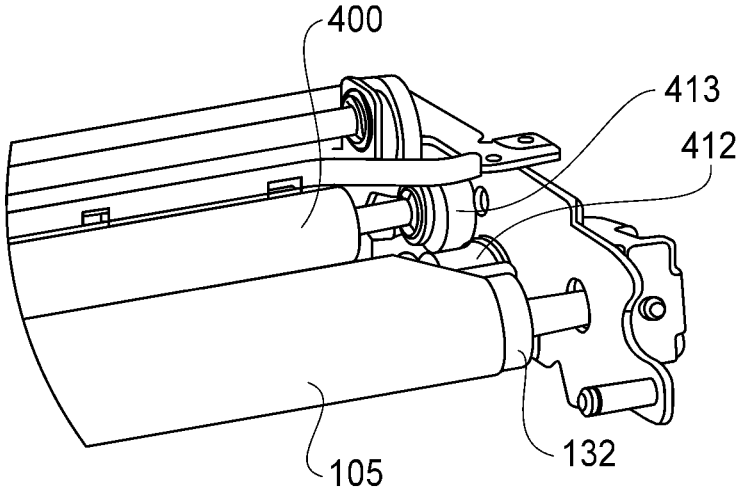

Referring to FIGS. 1 and 7A and 7B, a roughening mechanism for performing refreshing of a surface property of the fixing belt 105 will be described. The roughening roller 400 is a member rotatably supported by an RF supporting arm 141 via a bearing. The RF supporting arm 141 is a member rotatably supported by a fixing shaft 142 on a side plate 140. The roughening roller 400 is driven by an RF driving gear 401 fixed at an end portion of the driving roller 131 and an RF gear 403 fixed at an end portion of the roughening roller 400, and is rotated in a direction opposite to the rotational direction of the fixing belt 105.

The RF supporting arm 141 supports the roughening roller 400 at one end portion and holds an RF spacing spring 405 at the other end portion. The RF spacing spring 405 is held by an RF spacing shaft 406. The RF supporting arm 141 is urged toward an RF cam 407 by the RF spacing spring 405. The RF cam 407 is fixed on an RF cam shaft 408. On the RF cam shaft 408, an RF mounting and demounting gear 409 is fixed. When the RF pressing motor 410 rotates, the RF cam shaft 408 is rotated via an RF motor gear 411. In this way, the RF supporting arm 141 is moved upward and downward in accordance with a profile of the RF cam 407, so that the roughening roller 400 moves between the pressing position (contact position) for forming a roughening nip R and a spaced position.

In this embodiment, in the case where the roughening roller 400 is in the pressing position, the roughening roller 400 contacts a full widthwise belt region of an upper portion of the fixing belt 105 in a region where the fixing belt 105 is supported by (wound around) the driving roller 131. That is, the driving roller 131 functions as a back-up member for bringing the roughening roller 400 and the fixing belt 105 into contact with each other.

At a shaft end portion of the driving roller 131, a roughening roller driving gear 412 is provided, and at a shaft end portion of the roughening roller 400, a roughening roller driving gear 413 is provided. When the roughening roller 400 is press-contacted to the surface of the fixing belt 105, the roughening roller driving gears 412 and 413 are engaged with each other. Thus, the roughening roller 400 to which the drive of the driving roller 131 is transmitted is rotated in a direction opposite to the rotational direction of the fixing belt 105.

That is, the roughening roller 400 rotates the same direction (in which the surfaces of the roughening roller 400 and the fixing belt 105 move in the same direction) as the fixing belt 105 at the roughening nip (contact roller) R with a predetermined peripheral speed difference. The roughening roller 400 has an abrasive layer at the surface thereof and is capable of rubbing the fixing belt surface by contact thereof with the surface of the fixing belt 105. Accordingly, by the rotation of the roughening roller 400 in the same direction as the fixing belt 105, the roughening roller 400 is capable of roughening (leveling) the surface of the fixing belt 105 uniformly to have a desired roughness. That is, the roughening roller 400 executes a roughening operation (roughening process) for roughening the surface of the fixing belt 105 to the desired roughness, by the contact thereof with the rotating fixing belt 105.

The surface roughness of the fixing belt 105 is influenced by a difference (peripheral speed difference) between surface speeds of the fixing belt 105 and the roughening roller 400. That is, when the surface speed difference is small, the surface roughness of the fixing belt 105 becomes small, and when the surface speed difference is large, the surface of the fixing belt 105 becomes large. In this embodiment, in order to provide the fixing belt 105 with a desired roughness, the roughening operation is executed in a state in which the surface speed difference is 90 mm/s. In this embodiment, the ratio between the roughening roller driving gears 412 and 413 is 1.3:1, and in this state, the driving motor is rotated at 3000 rpm.

The roughening roller 400 has a constitution in which abrasive grains are closely bonded toward a surface of a metal core, formed of stainless steel and of 12 mm in diameter, via an adhesive layer. That is, the roughening roller 400 has a layer of the abrasive grains at the surface thereof. As the abrasive grains, those of #1000 to #4000 can be properly selected in accordance with a use (target glossiness of the image). The average particle size of abrasive grains 93*b* is 16 μm in the case of #1000 and is 3 μm in the case of #4000. The abrasive grains are alumina-based abrasive grains (so-called "alundum" or "molundum"). The alumina-based abrasive grains are most widely used and are considerably high in hardness compared with the surface of the fixing belt 105, and are excellent in abrasive property since the abrasive grains have an acute shape.

In the case where the roughening operation is performed using the roughening roller 400 in the above-described condition, the surface of the fixing belt 105 can be roughened to have a surface roughness Rz of 0.5 μm or more and 1.0 μm or less. When the fixing belt 105 having such a roughness is incorporated in the fixing device 100 and is used for the fixing, an image defect due to the surface roughness of the fixing belt 105 does not appear. That is, an image having a proper glossiness can be fixed on the sheet P.

Figure 8:
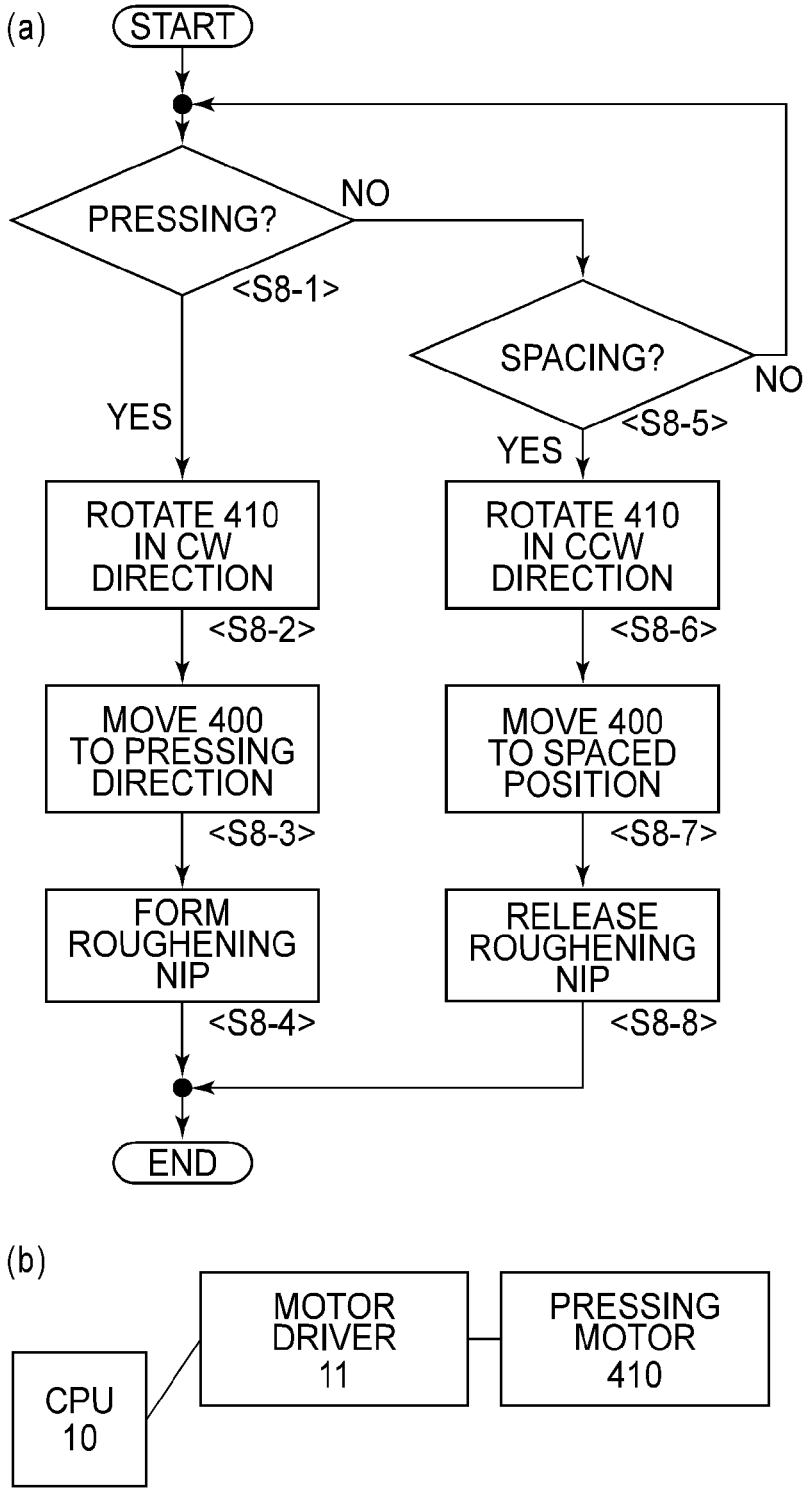
In FIG. 8, (a) is a flowchart for illustrating a fixing nip forming operation in the embodiment, and (b) is a block diagram of a constitution relating to control of the fixing nip forming operation in the embodiment.

A flowchart and block diagram which show a pressing operation of a pressing mechanism for the roughening roller 400 used in this embodiment are shown in (a) and (b) of FIG. 8, respectively.

The fixing device 100 controls the pressing operation by control of the CPU 10.

In the case where the roughening nip R is formed, the CPU 10 provides a pressing instruction to a motor driver 12 <S8-1>. After receiving the pressing instruction from the CPU 10, the motor driver 12 rotates the RF pressing motor 410 in the clockwise (CW) direction by a predetermined number (M) of rotations <S8-2>. Then, driving of the pressing motor 410 is transmitted to an RF cam shaft by the RF mounting and demounting gear 409, so that the roughening roller 400 supported by the RF supporting arm 141 is moved to a pressing position (contact position) <S8-3>. When the roughening roller 400 is moved to the pressing position, the fixing belt 105 and the roughening roller 400 are press-contacted to each other, so that the roughening nip R is formed <S8-4>.

In the case where the formation of the roughening nip R is eliminated, the CPU 10 provides a spacing instruction to the motor driver 12<S8-5>. The motor driver 12 receiving the spacing instruction from the CPU 10 rotates the RF pressing motor 410 in the counterclockwise (CCW) direction by a predetermined number (M) rotations <S8-6>. Then, the roughening roller 400 supported by the RF supporting arm 141 is moved to the spaced position <S8-7>, so that the roughening nip R is eliminated <S8-8>. That is, the RF supporting arm 141, the RF spacing spring 405, the RF spacing shaft 406, the RF cam 407, the RF cam shaft 408 and the pressing motor 410 function as a moving mechanism for moving the roughening roller 400 relative to the fixing belt 105 so that the roughening roller 400 is movable between the pressing position and the spaced position.

(2-3) Separating Plate

Figure 9A:
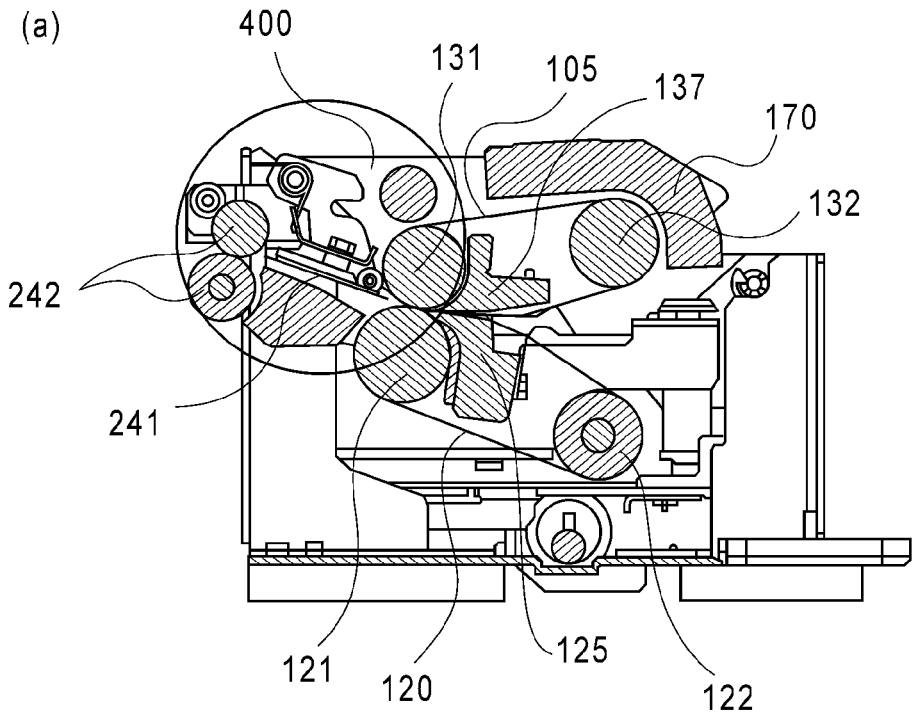
In FIG. 9A, (a) is a sectional view showing a constitution at a periphery of a separating member, and (b) is a partly enlarged view of (a).
Figure 9A:
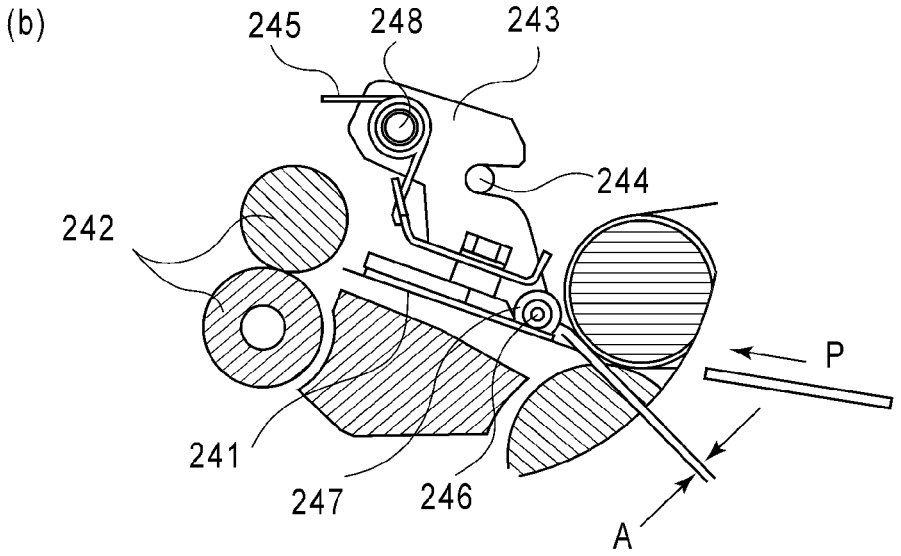
Figure 9B:
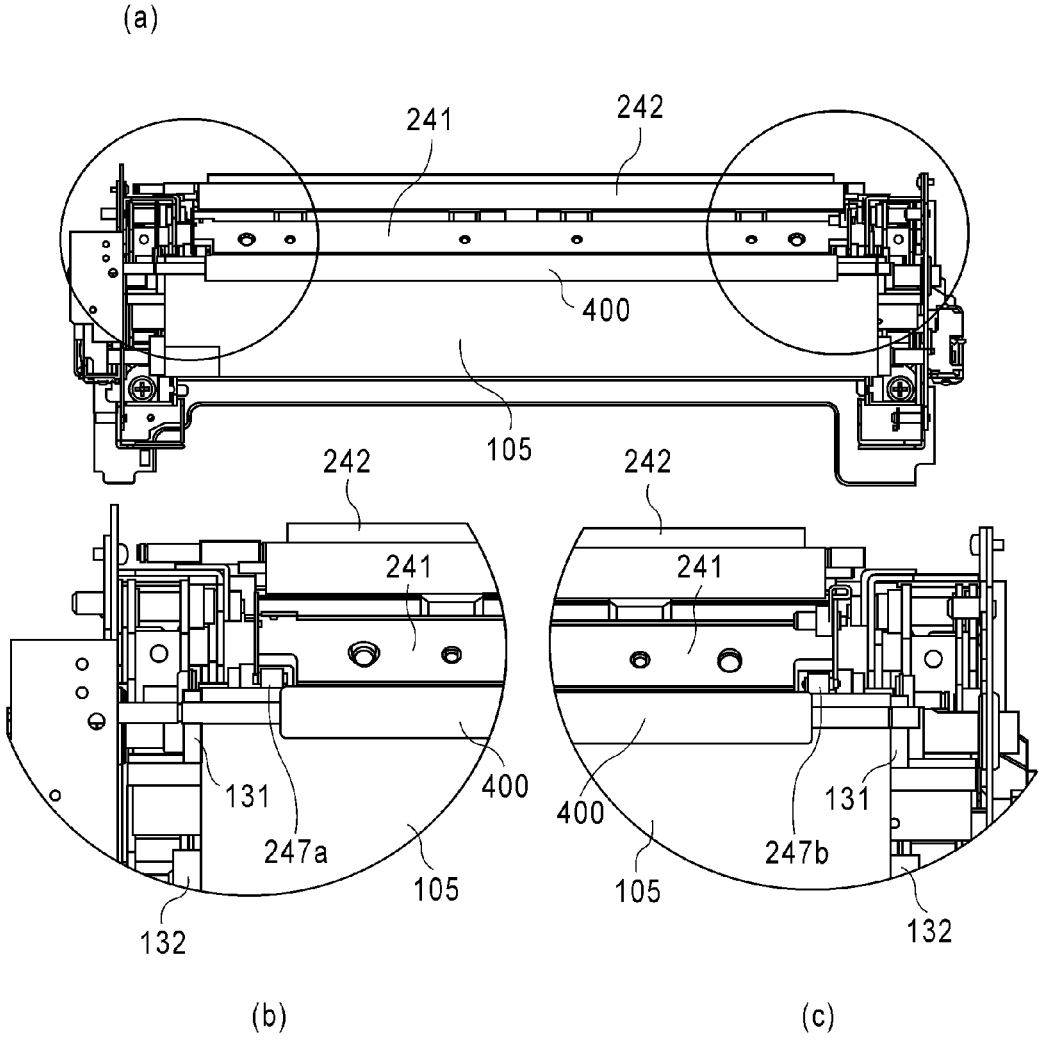
In FIG. 9B, (a) is a top view showing the constitution at the periphery of the separating member, (b) is a partly enlarged view of (a), and (c) is a partly enlarged view of (a).
Figure 10:
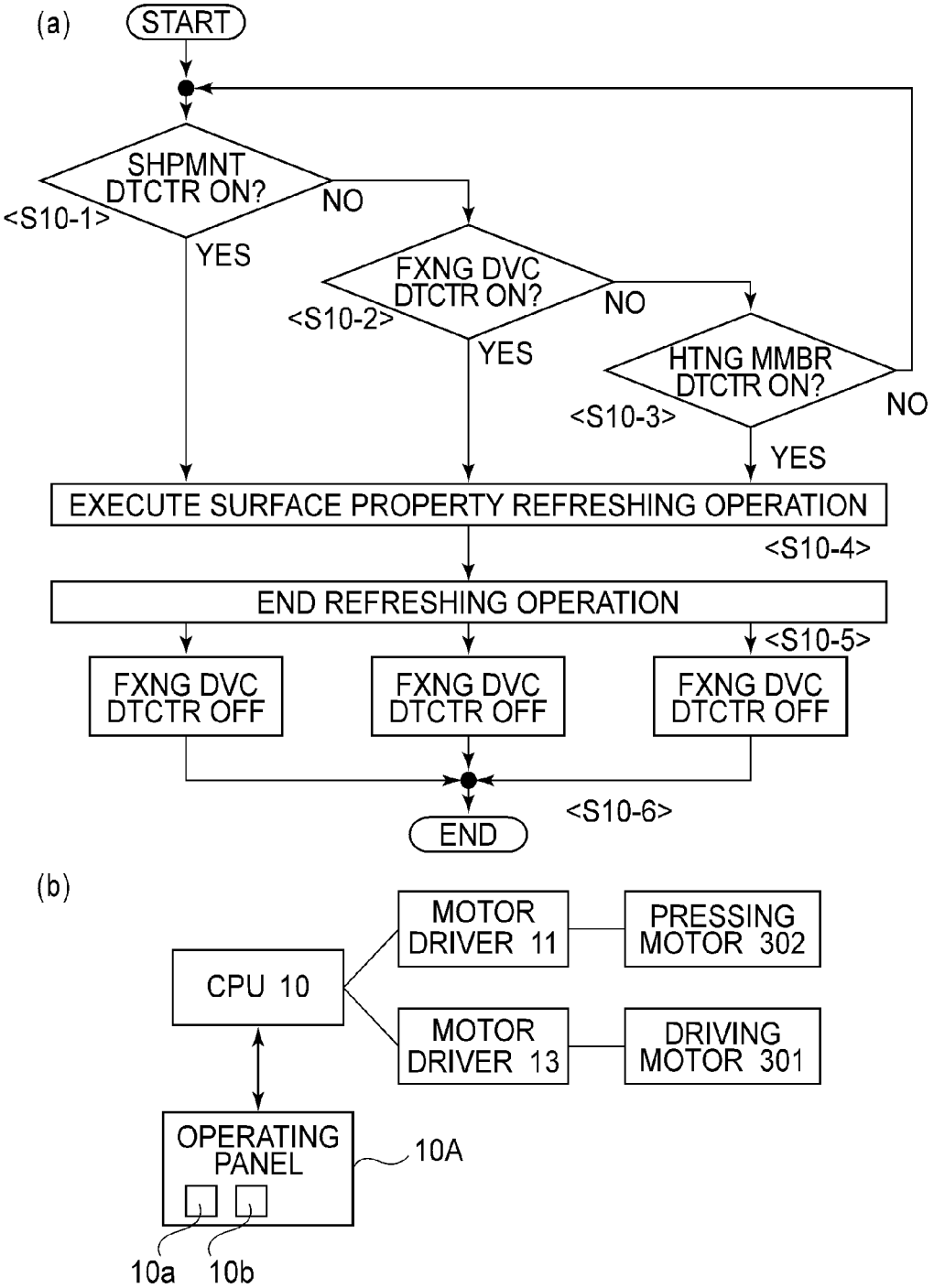
In FIG. 10, (a) is a flowchart for illustrating control of a surface property refreshing operation in the embodiment, and (b) is a block diagram of a constitution relating to the control of the surface property refreshing operation in the embodiment.

Referring to FIGS. 9A, 9B and 10, a constitution of a separating plate 241 which is an auxiliary means for separating, from the fixing belt 105, the sheet P coming out of the fixing nip U in the fixing device 100 will be described.

The separating plate 241 is provided closely to the fixing belt 105 in a sheet exit side of the fixing nip U so that an upstream end thereof with respect to the sheet feeding direction is in non-contact with the fixing belt 105. The other end of the separating plate 241 functions as a guiding member for guiding the sheet P to a fixing-discharging roller pair 242 downstream thereof with respect to the sheet feeding direction. In this embodiment, a gap A between a free end (upstream end) of the separating plate 241 and the fixing belt 105 is 0.5 mm.

The separating plate 241 is supported by a separating plate holder 243. The separating plate holder 243 is supported rotatably about a rotation center shaft 244 of the separating plate 241 at a widthwise end portion of the fixing belt 105. Then, the separating plate holder 243 is urged in the counterclockwise direction about the center shaft 244 by a spring 245. Then, the end of the separating plate 241 is urged in a direction in which the separating plate 241 approaches the fixing belt 105. At end portions of the separating plate holder 243 with respect to a longitudinal direction, a shaft 246 and rollers 247*a* and 247*b* rotatably supported by the shaft 246 are independently provided in front and rear sides, respectively. Each of the rollers 247*a* and 247*b* is pressed with a predetermined pressing force (e.g., 0.03N) so as to contact the belt 105 by an urging force of the spring 245. As a material for the rollers 247*a* and 247*b*, any material may be appropriately selected if the material has a heat-resistant property, and PFA can be used, for example.

(2-4) Surface Property Refreshing Operation Mode During Initial Disposition of Apparatus Referring to FIG. 10, a surface property refreshing operation mode of the fixing belt 105 by the roughening roller 400 during initial disposition of the image forming apparatus 500 will be described. In the following, of the image forming apparatus 500, a group of constituent elements relating to image heating will be referred to as an image heating apparatus. That is, the image heating apparatus includes the CPU 10 and an operating panel 10A described later in addition to the fixing device 100.

When fixing devices 100 in a brand-new condition are shipped from a factory, the fixing devices 100 are transported to designations thereof. In this case, when an unexpected external force is applied to the fixing device 100 by vibration or the like during transportation, there is a liability that parts in the apparatus interfere with each other in response to receiving a shock (impact). Specifically, there is a liability that the separating plate 241 disposed closely to the surface of the fixing belt 105 in a non-contact state damages the surface of the fixing belt 105. Then, even when the fixing belt 105 is in the brand-new condition, the surface of the fixing belt 105 does not have a desired roughness, so that it is difficult to output an image at a desired quality. Also in the following case, the surface of the fixing belt 105 in the brand-new condition does not have the desired roughness. For example, in the case where there is a defective portion in a roughening step of a manufacturing process of the fixing belt 105, the fixing device 100 is shipped in some instances before the surface of the fixing belt 105 has the desired roughness. The influence on the image due to the surface roughness is not limited to that by the fixing belt 105, but also the surface roughness of the pressing belt 120 has an influence on the image (particularly on double-side images). Accordingly, in the case where the surface of the pressing belt 120 is required to have the desired roughness, a surface roughening operation may be executed in the case where a roughening roller is provided in a pressing belt side and the pressing belt 120 is detected as being in a brand-new condition. That is, the rotatable member whose surface is roughened by the roughening roller 400 may also be the pressing belt 120. Further, both the fixing belt 105 and the pressing belt 120 may also be surface-roughened by the roughening roller 400. That is, at least one of the pair of rotatable members for forming the nip is the rotatable member to be surface-roughened by the roughening roller 400. However, damage of the fixing belt 105 generated by the contact with the separating plate 241 has the largest influence on the image. The fixing device 100 functions as an exchange unit including the fixing belt 105 and the separating plate 241.

Therefore, in the case where the fixing belt 105 in this embodiment is detected as being in brand-new condition, the surface roughening operation of the fixing belt 105 is executed. Specifically, in the case where the fixing belt 105 is exchanged, the fixing device 100 executes the surface roughening operation of the fixing belt 105. Further, when the fixing device 100 used in the image heating apparatus is exchanged (replaced) with a fixing device 100 including the fixing belt 105 in a brand-new condition, the fixing device 100 executes the surface roughening operation of the fixing belt 105. Further, in the case where the image heating apparatus in which is incorporated the fixing device 100 in the brand-new condition is initially disposed, the fixing device 100 executes the surface roughening operation of the fixing belt 105.

Therefore, the image heating apparatus includes a detecting means for detecting that the image heating apparatus is initially disposed. That is, the image heating apparatus includes an obtaining means for obtaining information indicating that the image heating apparatus is initially disposed. The image heating apparatus further includes a detecting means for detecting that the fixing device 100 is exchanged. That is, the image heating apparatus includes an obtaining means for obtaining information indicating that the fixing device 100 is exchanged. Or, the image heating apparatus includes a detecting means for detecting that the fixing belt 105 is exchanged. That is, the image heating apparatus includes an obtaining means for obtaining information indicating that the fixing belt 105 is exchanged.

In the fixing device 100 in this embodiment, during initial shipping of the image heating apparatus, the timing when a shipping clear button 10*a* is pressed is used as a trigger for detection by using the pressing of the shipping clear button 10*a* at an operating panel (operating portion) 10A of the image heating apparatus. That is, the trigger is turned on at a timing of the initial shipping of the image heating apparatus. Specifically, the operating panel 10A outputs, to the CPU 10, information indicating that the fixing device 100 (the fixing belt 105) is in the brand-new condition.

Further, in the fixing device 100 in this embodiment, during exchange of the fixing device 100 with a fixing device 100 in a brand-new condition or during exchange of the fixing belt 105 with a fixing belt 105 in a brand-new condition, the timing when a counter reset button 10*b* is pressed is used as a trigger for detection by using the pressing of the counter reset button 10*b* for resetting the count of the number of times of use of the fixing belt 105 (i.e., the number of sheets subjected to the fixing or the number of sheets passing through the fixing nip U). That is, the trigger is turned on by the fixing device 100 at a timing of completion of the exchange of the fixing device 100 or the fixing belt 105. Specifically, the operating panel 10A outputs, to the CPU 10, information indicating that the fixing device 100 (the fixing belt 105) is in the brand-new condition.

The surface property refreshing operation will be described with reference to FIG. 10.

In the case where the image heating apparatus is shipped, the image heating apparatus is transported to a disposing place while being kept in a detection trigger-ON state. Then, when a power source for the image heating apparatus is turned on for initial disposition, the CPU 10 checks that the trigger is in the ON state <S10-1>. That is, the CPU 10 functions as an obtaining means for obtaining information indicating that the fixing device 100 (the fixing belt 105) is in the brand-new condition.

In the case where the fixing device 100 in the brand-new condition is incorporated in the image heating apparatus for the exchange of the old fixing device 100, the image heating apparatus prompts a user (operator) to press the counter reset button 10*b* after the mounting of the fixing device 100 is completed. Then, when the counter reset button 10*b* is pressed by the user (operator), the CPU 10 checks that the trigger is in the ON state <S10-2>. That is, the CPU 10 functions as an obtaining means for obtaining information indicating that the fixing device 100 (the fixing belt 105) is in the brand-new condition.

In the case where the fixing belt 105 in the brand-new condition is incorporated in the image heating apparatus for the exchange of the old fixing belt 105, the image heating apparatus prompts a user (operator) to press the counter reset button 10*b* after the mounting of the fixing device 100 is completed. Then, when the counter reset button 10*b* is pressed by the user (operator), the CPU 10 checks that the trigger is in the ON state <S10-3>. That is, the CPU 10 functions as an obtaining means for obtaining information indicating that the fixing device 100 is in the brand-new condition.

In either of the above-described conditions, when the trigger-ON state is confirmed, the CPU 10 executes an instruction for the surface property refreshing operation (roughening operation). That is, the CPU 10 functions as the obtaining means for obtaining the information indicating that the fixing device 100 (the fixing belt 105) is in the brand-new condition from an output of the operating panel 10A as an operating means. Further, in the case where the above information is obtained, the CPU 10 functions as a control means for controlling a moving mechanism so that the roughening roller 400 moves to the contact position.

The CPU 10 in this embodiment obtains the information showing that the fixing belt 105 is in the brand-new condition from the operating panel 10A, but an obtaining source is not limited to the operating panel 10A. For example, a detecting means such as a reading sensor for detecting the brand-new condition of the fixing belt 105 by reading an IC tag attached to the fixing belt 105 may also be used. Then, the CPU 10 may also execute the surface property refreshing operation of the fixing belt 105 depending on an output of the reading sensor.

By control of the CPU 10, the surface property refreshing operation described above with reference to FIG. 8 is executed <S10-4>. The CPU 10 executes the surface property refreshing operation of the fixing belt 105 for a predetermined time. The predetermined time for which the surface property refreshing operation is executed may desirably be a time of at least one rotation of the fixing belt 105.

When an ending condition is satisfied, the CPU 10 ends the surface property refreshing operation <S10-5>. Then, the CPU 10 turns off the trigger for the initial shipping of the image forming apparatus 500, the exchange of the fixing device 100 with the fixing device 100 in the brand-new condition or the exchange of the fixing belt 105 with the fixing belt 105 in the brand-new condition <S10-6>. In this way, the fixing device 100 is in a state in which the fixing is executable, and the CPU 10 is in a stand-by state for a print job. That is, the CPU 10 moves the roughening roller 400 to the contact position in a period from the detection that the fixing device 100 is in the brand-new condition until the fixing is executed. Then, the CPU 10 maintains the roughening roller 400 at the contact position in a period from the movement of the roughening roller 400 to the contact until the fixing belt 105 rotates at least one full turn. Then, the CPU 10 moves the roughening roller 400 from the contact position to the spaced position in a period until the fixing is executed.

In this way, in this embodiment, in the fixing device including the roughening member for roughening the surface of the fixing belt 105, the roughening operation of the fixing belt 105 by the roughening member is executed in the case where the fixing device 100 is in the brand-new condition. For that reason, even when the surface of the fixing belt 105 in the fixing device 100 in the brand-new condition does not have a desired roughness by, e.g., contact of the separating plate 243 with the surface of the fixing belt 105 during transportation, a high-quality image can be formed stably from an initial stage of the execution of the fixing.

(2-5) Surface Property Refreshing Operation Mode During Fixing

In the above, the surface property refreshing operation of the fixing belt 105 during the detection of the brand-new condition of the fixing device 100 was described. In this embodiment, also during the execution of the fixing, the surface property refreshing operation of the fixing belt 105 is performed. For that reason, referring to FIG. 11, the surface property refreshing operation of the fixing belt 105 by the roughening member 400 during the fixing will be described.

The sheet P on which the toner image is formed by the photosensitive drum 511 and the transfer roller 535 and which is fed to the fixing device 100 is guided by an entrance guide 184 provided on the lower frame 124, and thereafter enters the fixing nip U. The entrance guide 184 is provided with a flag sensor 185 including a photo-interrupter, and the flag sensor 185 detects timing of passing of the sheet P.

The sheet P on which the toner image is fixed by being heated and pressed in the fixing nip U is discharged through the fixing nip U. Thereafter, the sheet P is fed and discharged onto the discharge tray 565 by the discharging roller pair 540.

The CPU 10 counts the number of sheets P subjected to the fixing, and in the case where a predetermined number N of sheets P is subjected to the fixing, after the printing operation, the surface property refreshing operation of the fixing belt 105 by the roughening member 400 is performed for a predetermined time.

Figure 11A:
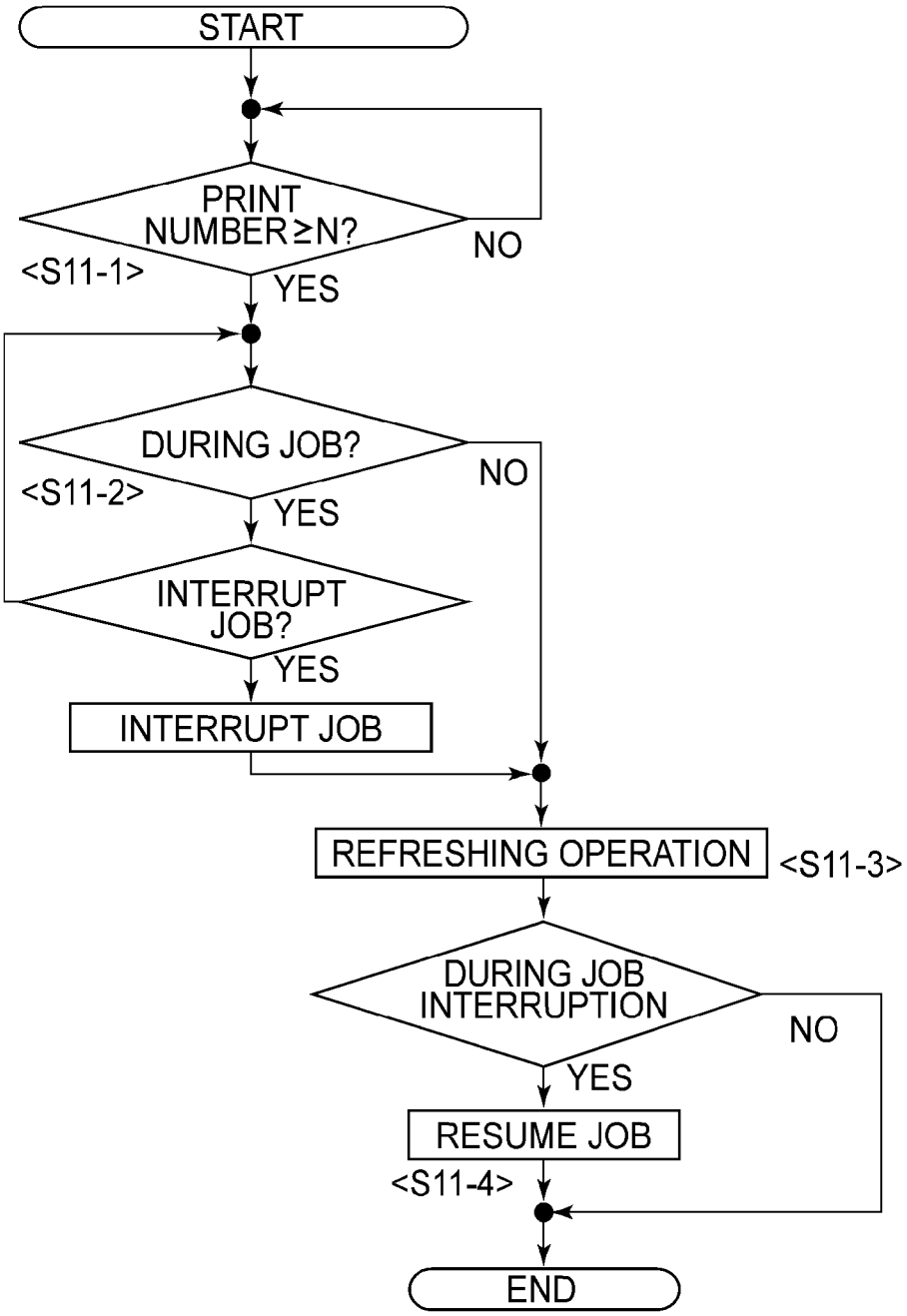
FIG. 11A is a flowchart for illustrating the control of the surface property refreshing operation in the embodiment.
Figure 11B:
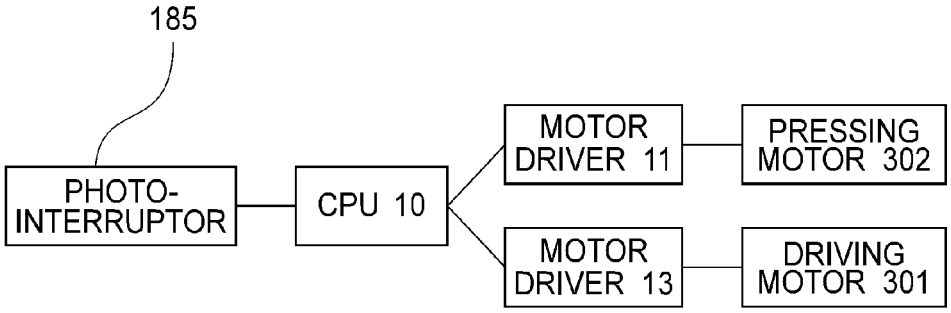
FIG. 11B is a block diagram of a constitution relating to the control of the surface property refreshing operation in the embodiment.

The surface property refreshing operation will be described with reference to FIG. 11. After the fixing of the predetermined number of sheets, when the CPU 10 provides a control instruction for the surface property refreshing operation <S11-1>, after end of the print job or interruption of the print job <S11-2>, the surface property refreshing operation is started <S11-3>. When the surface property refreshing operation is ended after a lapse of a predetermined time from the start thereof, the interrupted print job is resumed <S11-4> or the CPU 100 is in a stand-by state for the print job.

In this embodiment, the fixing device 100 executing the surface property refreshing operation after the fixing of the predetermined number of sheets was described. However, the fixing device 100 may also execute the surface property refreshing operation on the basis of a count, of the number of sheets subjected to the fixing, performed only in the case where the image is fixed on specific sheets P. Further, the fixing device 100 may also execute the surface property refreshing operation before the print job of the specific sheets P. Or, the fixing device 100 may also perform the surface property refreshing operation of the fixing belt 105 by an operation of the user through the operating panel 10A.

However, in either case, the surface property refreshing operation is not executed on the basis of the detection of the brand-new condition of the fixing device 100.

Other Embodiments (1) In the present invention, the image forming portion 510 of the image forming apparatus 500 is not limited to that of the electrophotographic type. Image forming apparatuses for forming the unfixed toner images on the sheets P by using other known transfer-type or direct-type image forming principles or types such as an electrostatic recording type and a magnetic recording type may also be used.

(2) The image forming apparatus is not limited to the color image forming apparatus, but may also be a monochromatic (single-color) image forming apparatus for forming a monochromatic image or the like, in which a single image bearing member (photosensitive drum or the like) is provided.

(3) In this embodiment, as the fixing device 100, the fixing device 100 in which the fixing belt 105 and the pressing belt 120 are the belt members was described, but a similar effect can also be obtained even when the present invention is applied to a fixing device in which both are roller members or a fixing device in which either one is the belt.

(4) It is also possible to employ a device constitution in which the nip forming members (pressing member and opposing member) for forming the nip U in combination with the fixing belt 105 are non-rotatable members. That is, it is possible to employ a device constitution in which the nip forming members are non-rotatable members such as a pad member, a plate-like member and the like which have smooth surfaces having small friction efficiency with the pressing member 105 or the sheet P.

(5) The heating means for the rotatable heating member 105 and the nip forming member 120 is not limited to the electromagnetic induction heating means. The heating means can also have a device constitution employing proper heating means or heating type, such as a halogen heater, a ceramic heater or an infrared lamp, which heat the rotatable heating member 105 or the nip forming member 120 from an inside or an outside.

(6) The image heating apparatus is not limited to that having such a constitution in which the unfixed toner image is fixed on the sheet by using the fixing device 100. The image heating apparatus may also have a constitution in which the toner image once or temporarily fixed on the sheet is heated again to modify glossiness or the like by using a glossing device.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-102159 filed on May 16, 2014, which is hereby incorporated by reference herein in its entirety.

What is claimed is:

1. An image heating apparatus comprising:

first and second rotatable members configured to heat an image on a sheet at a nip;

a roughening member configured to perform roughening of a surface of said first rotatable member when at least said first rotatable member of said first and second rotatable members rotates;

a moving mechanism configured to move said roughening member relative to said first rotatable member so that said roughening member is movable between a contact position where said roughening member is contacted to said first rotatable member and a spaced position where said roughening member is spaced from said first rotatable member;

obtaining means configured to obtain information indicating that said first rotatable member is new; and control means configured to control said moving mechanism to perform the roughening upon obtaining of the information by the obtaining means.

2. An image heating apparatus according to claim 1, wherein said control means controls said moving mechanism so that the roughening is performed in a period from the obtaining of the information by said obtaining means until heating of the image on the sheet is executed.

3. An image heating apparatus according to claim 2, wherein said control means controls said moving mechanism to move said roughening member from the contact position to the spaced position in a period from movement of said roughening member to the contact position, depending on the obtaining of the information by said obtaining means, until image heating is executed.

4. An image heating apparatus according to claim 1, wherein said control means maintains said roughening member at the contact position during at least one rotation of said first rotatable member after said roughening member is moved to the contact position, depending on the obtaining of the information by said obtaining means.

5. An image heating apparatus according to claim 1, wherein said roughening member roughens the surface of said first rotatable member to have a surface roughness of 0.5 μm or more and 1.0 μm or less.

6. An image heating apparatus according to claim 5, wherein said roughening member has a layer of abrasive grains at a surface thereof, and the abrasive grains have an average particle size of 3 μm-16 μm.

7. An image heating apparatus according to claim 6, wherein said roughening member is a roughening roller rotatable in a direction opposite to a rotational direction of said first rotatable member.

8. An image heating apparatus according to claim 1, further comprising operating means operable by an operator, wherein said operating means outputs the information to said obtaining means when a predetermined operation is performed.

9. An image heating apparatus according to claim 1, further comprising a separating member, provided adjacent to the surface of said first rotatable member, configured to separate the sheet from said first rotatable member, wherein said first rotatable member and said roughening member are provided in a unit detachably mountable to said image heating apparatus, and wherein said obtaining means obtains the information on the basis of said unit being in a brand-new condition.

10. An image heating apparatus according to claim 1, wherein said first rotatable member is a rotatable heating member configured to heat the image on the sheet in contact with an image carrying surface of the sheet.

* * * * *